US010225646B2

(12) United States Patent
Qin et al.

(10) Patent No.: US 10,225,646 B2
(45) **Date of Patent: *Mar. 5, 2019**

(54) SPEAKER BOX

(71) Applicant: AAC Technologies Pte. Ltd., Singapore (SG)

(72) Inventors: Peng Qin, Shenzhen (CN); Shengrong Shi, Shenzhen (CN); Zhe Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/856,876

(22) Filed: Dec. 28, 2017

(65) Prior Publication Data

US 2019/0014407 A1 Jan. 10, 2019

(30) Foreign Application Priority Data

Jul. 4, 2017 (CN) ..... 2017 1 0536964

(51) Int. Cl.
*H04R 1/28* (2006.01)
*H04R 1/02* (2006.01)
*H04R 31/00* (2006.01)

(52) U.S. Cl.
CPC ..... *H04R 1/2888* (2013.01); *H04R 1/023* (2013.01); *H04R 1/025* (2013.01); *H04R 31/00* (2013.01)

(58) Field of Classification Search
CPC .... H04R 1/2888; H04R 1/2892; H04R 1/023; H04R 1/025; H04R 31/00
See application file for complete search history.

(56) References Cited

U.S. PATENT DOCUMENTS

| | | | | |
|---|---|---|---|---|
| 9,525,933 | B2 * | 12/2016 | Chen | H04R 1/2842 |
| 9,838,765 | B1 * | 12/2017 | Li | H04R 1/023 |
| 9,986,321 | B1 * | 5/2018 | She | H04R 1/025 |
| 2014/0023224 | A1 * | 1/2014 | Tao | H04R 1/02 381/412 |
| 2014/0079263 | A1 * | 3/2014 | Chang | H04R 1/2803 381/332 |
| 2015/0304747 | A1 * | 10/2015 | Wang | H04R 5/02 381/345 |
| 2016/0225362 | A1 * | 8/2016 | Xu | G10K 11/002 |
| 2016/0227314 | A1 * | 8/2016 | Cai | H04R 1/2888 |
| 2016/0227322 | A1 * | 8/2016 | Xu | H04R 7/125 |

(Continued)

*Primary Examiner* — Mohammad K Islam
(74) *Attorney, Agent, or Firm* — Na Xu; IPro, PLLC

(57) ABSTRACT

A speaker box includes a housing with an accommodating space and a housing wall; a propping wall extending from the housing wall toward the accommodating space; and a speaker unit located between the housing wall and the propping wall for dividing the accommodating space into a front cavity and a back cavity. The speaker unit includes a diaphragm located in the front cavity for forming a front sound cavity cooperatively with the housing, a sound guiding channel communicating the front sound cavity with outside, and a through hole penetrating the propping wall and communicating the sound guiding channel with the back cavity. The speaker box further includes an elastic cover plate covering the through hole completely for absorbing vibration energy at a specific frequency. The Young's modulus or strength of the elastic cover plate is smaller than that of the propping wall.

10 Claims, 4 Drawing Sheets

(56) References Cited

U.S. PATENT DOCUMENTS

| | | | | |
|---|---|---|---|---|
| 2016/0345090 | A1* | 11/2016 | Wilk | B01D 53/04 |
| 2017/0289658 | A1* | 10/2017 | Mu | H04R 1/02 |
| 2017/0303033 | A1* | 10/2017 | Shao | H04R 1/025 |

* cited by examiner

SPEAKER BOX

CROSS-REFERENCE TO RELATED APPLICATIONS

This application claims the priority benefit of Chinese Patent Application Ser. No. 201710536964.1 filed on Jul. 4, 2017, the entire content of which is incorporated herein by reference.

FIELD OF THE PRESENT DISCLOSURE

The present disclosure relates to electro-acoustic transducers, more particularly to a housing of a speaker box.

DESCRIPTION OF RELATED ART

With the arrival of mobile internet era, the number of intelligent mobile devices is on the increase. Among the many mobile devices, mobile phones are undoubtedly the most common, most portable mobile terminal devices. At present, the mobile phone functions are extremely diverse, one of which is high quality music function, therefore, the speaker boxes used to play sounds are applied to current smart mobile devices in large quantities.

The speaker box of related art comprises a housing, a speaker unit accommodated in the housing, a leaking hole provided as penetrating the housing and a cover plate provided as covering the leaking hole, wherein, the speaker unit comprises a diaphragm for vibration and sound producing, the diaphragm is provided spaced from the housing to form a front sound cavity. The leaking hole and the diaphragm are provided opposite each other. The speaker box further comprises a sound guiding channel connecting the front sound cavity and the external environment, the front sound cavity and the sound channel form together the front cavity of the speaker box.

However, in the speaker box of related art, the inner walls of the front cavity are all rigid walls made up of rigid plastic material or metal material, the damp and the vibration amplitude of a rigid wall are small, its radiation energy is limited, and cannot effectively transmit the cavity energy in the front cavity out, thus it cannot absorb the energy of a specified frequency. Therefore, the rigid walls of the front cavity are prone to resonance because of the structure, which will then lead to sound distortion in the speaker box, affecting the acoustic performance of the speaker box.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
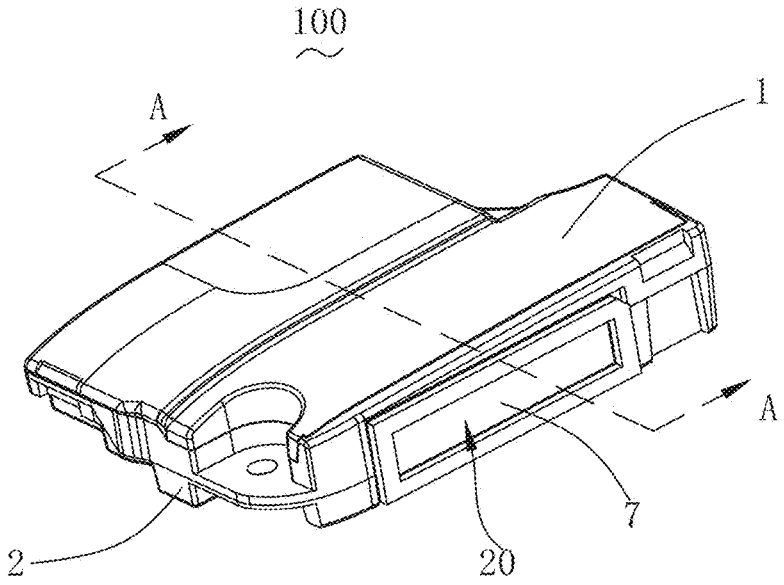
FIG. 1 is an isometric view of a speaker box in accordance with an exemplary embodiment of the present disclosure.
Figure 2:
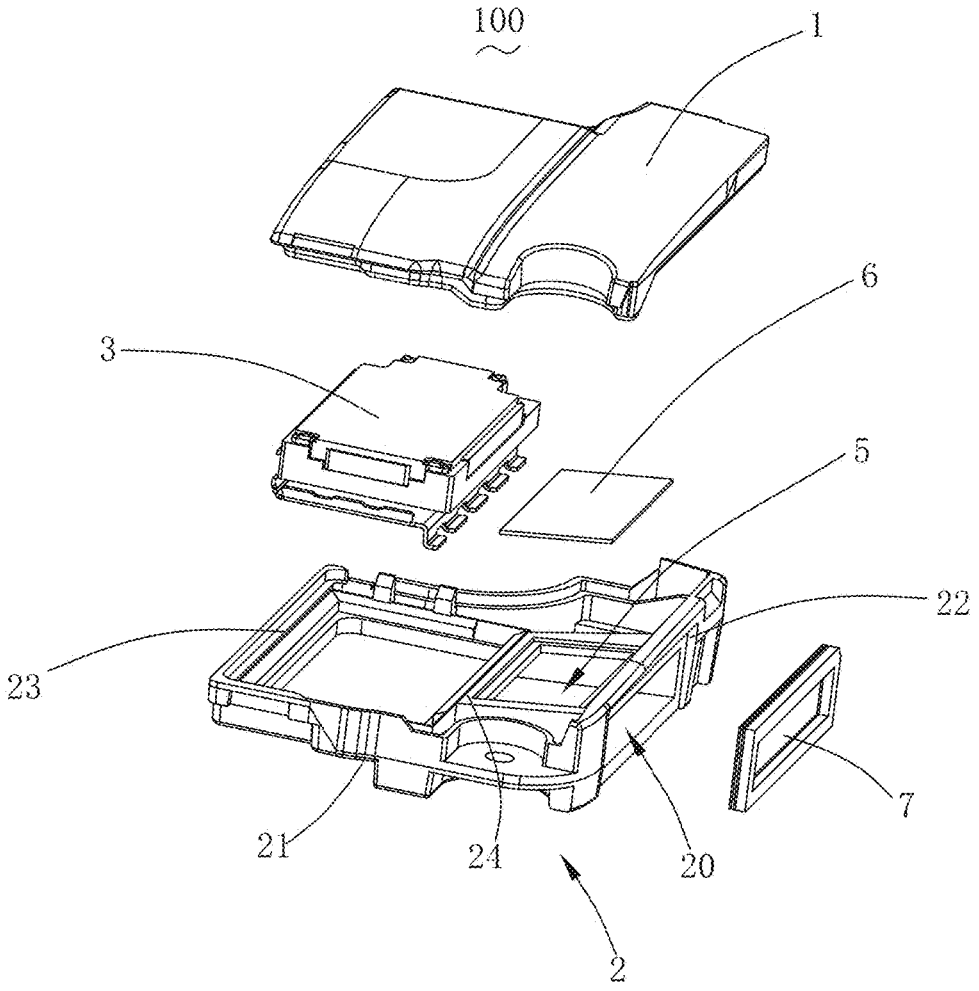
FIG. 2 is an exploded view of the speaker box in FIG. 1.
Figure 3:
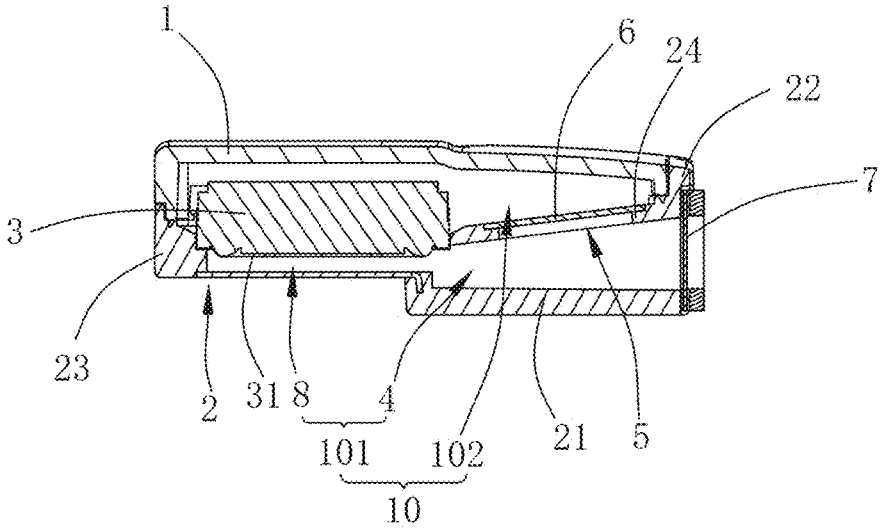
FIG. 3 is a cross-sectional view of the speaker box, taken long line A-A in FIG. 1.

Please refer to FIGS. 1-3, the present disclosures a speaker box 100 comprising a lower cover 1, an upper cover 2 provided as covering the lower cover 1, a speaker unit 3, a sound guiding channel 4, a through hole 5, an elastic cover plate 6 and a dust screen 7.

The upper cover 2 and the lower cover 1 cooperatively form an accommodation space 10. The upper cover 2 and the lower cover 1 can be integrated into a whole structure or can be divided into a separate structure.

The upper cover 2 comprises a bottom wall 21, a first side wall 22 and a second side wall 23 bending and extending from the bottom wall 21. The first side wall 22 and the second side wall 23 are opposite to each other. A sound outlet 20 is provided at the first side wall 22, a propping wall 24 is formed with the first side wall 22 bending and extending toward the second side wall 23. The speaker unit 3 is positioned between the propping wall 24 and the second side wall 23, by which the speaker unit is fixed on the upper cover 2 and divides the accommodating space 10 into a front cavity 101 and a back cavity 102. Preferably, the propping wall 24, the bottom wall 21, the first side wall 22 and the second side wall 23 are integrated structures.

The speaker unit 3 comprises a diaphragm 31 for vibration and sound producing, the diaphragm 31 is located in the front cavity 101, the diaphragm 31 and the bottom wall 21 are provided spaced apart to form a front sound cavity 8. The propping wall 24, the bottom wall 21 and the first side wall 22 form cooperatively the sound guiding channel 4. The sound guiding channel 4 is located in the front cavity, the sound guiding channel 4 connects the front sound cavity 8 with the outside through the sound outlet 20. The propping wall 24, the speaker unit 3 and the lower cover 1 together form the back cavity 102. It can be understood that, the propping wall 24 can also be provided in the lower cover 1, as long as the propping wall and the side walls can function together to hold the speaker unit.

That is to say, in this embodiment, the speaker unit 3 divides accommodating space 10 into a front cavity 101 and the back cavity 102, in which, the front cavity 101 comprises the front sound cavity 8 and the sound guiding channel 4, which are used for producing sound; the back cavity 102 has the function of improving the low frequency acoustic performance of the speaker box 100.

The through hole 5 is provided on the propping wall 24 and connects the sound guiding channel 4 with the back cavity 102. Specifically, the through hole 5 is provided penetrating the propping wall 24.

The elastic cover plate 6 is provided as covering the through hole 5 completely and is fixed at the propping wall 24, for example, fixed at the side of the propping wall 24 far from the sound guiding channel 4, the elastic cover plate is used for absorbing vibration energy at a specific resonance frequency. Specifically, the elastic cover plate 6 is fixed at the side of the propping wall 24 near the back cavity 102.

Preferably, the elastic cover plate 6 and the propping wall 24 or the sound guiding channel 4 of the propping wall 24 are fixedly connected by double-shot molding or hot pressing or pasting or ultrasonic welding. Of course, the elastic cover plate 6 and the propping wall 24 can also be integrated structures.

In this embodiment, the Young's modulus or strength the elastic cover plate 6 is smaller than that of the upper cover 2 or lower cover 1.

In this disclosure, the elastic cover plate 6 will replace the rigid wall of related technologies, and the elastic cover plate 6 has a resonant frequency, when, through design, the resonant frequency of the elastic cover plate 6 is adjusted to a certain frequency, the elastic cover plate 6 will produce strong vibration near the resonance frequency, when the speaker box 100 produces sounds and the speaker unit 3 vibrates, the air in the front cavity will be compressed and energy will be produced, this energy will drive the elastic cover plate 6 to vibrate, thus the energy in the front cavity will be consumed, preferably, the elastic cover plate 6 vibrates at the resonant frequency, under which condition the vibration intensity will reach the maximum, thus more energy can be consumed; and thus the aim of absorbing energy near the specific frequency can be achieved; in addition, by replacing the rigid wall with the elastic cover plate 6, the medium density in the front cavity 101 can be transmitted to the outside of the front cavity 101, thereby reducing the resonance phenomenon of the speaker box 100 and improving distortion.

Specifically, the purposes mentioned above are achieved by designing the material, area, shape and thickness of the elastic cover plate 6. In this embodiment, the elastic cover plate 6 is made up of material with low Young's modulus or strength, at least below that of the upper cover 2 or lower cover 1, such as TPU or MCP or silica gel. Then they are fixedly connected by double-shot molding or hot pressing or pasting or ultrasonic welding, forming part of the structure of the front cavity 101, absorbing the energy in the front cavity 101 of the speaker box 100 near resonant peak, and achieving the purpose of decreasing resonance peak, reducing distortion and improving the acoustic performance of the speaker box 100. The elastic cover plate 6 can be designed and adjusted according to the range of the resonant frequency that needs to be absorbed. The specific resonant frequency is just the set range of resonance frequency that needs to be absorbed.

The dust screen 7 is pasted and fixed on the outer side of the sound outlet 20, to prevent the foreign substance from entering the front cavity 101 and affecting the acoustic performance of the speaker box 100.

Figure 4:
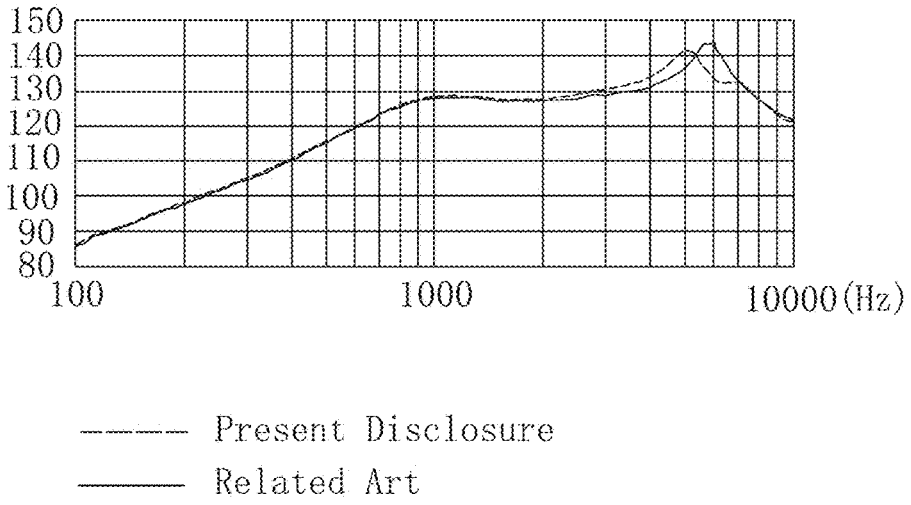
FIG. 4 shows a comparison of frequency response curves between the speaker box of the present disclosure (using an elastic cover plate) and a speaker box (using a rigid wall) of the related art.

Please refer to FIG. 4, a frequency response curve of the speaker box (using an elastic cover plate) of the invention and a speaker box (using a rigid wall) of the related art. As shown in FIG. 4, in the frequency response curve of the speaker box 100 of the invention which uses the elastic cover plate 6, the resonance peak decreases obviously, meaning the resonance phenomenon is reduced.

Figure 5:
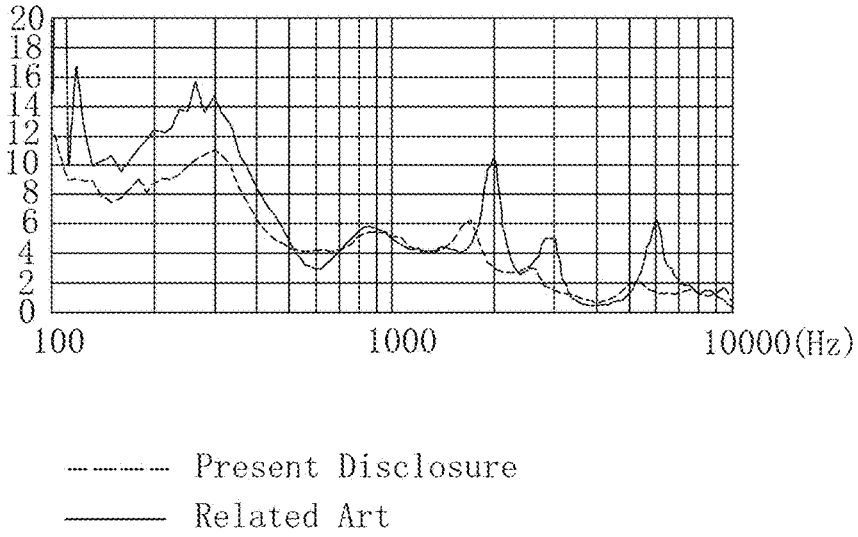
FIG. 5 shows a comparison of total harmonic distortion curves of the speaker box (using an elastic cover plate) of the present disclosure and a speaker box (using a rigid wall) of the related art.

Please refer to FIG. 5, a total harmonic distortion curve of the speaker box (using an elastic cover plate) of the invention and a speaker box (using a rigid wall) of the related art. As shown in FIG. 5, in the total harmonic distortion curve of the speaker box 100 of the invention which uses the elastic cover plate 6, the distortion spike decreases obviously, meaning distortion is reduced.

In the speaker box 100 of the invention, the resonance frequency of the elastic cover plate 6 is 500-15000 Hz: that is, the resonance frequency the elastic cover plate 6 can absorb is 3000-9000 Hz.

When the resonance frequency of the elastic cover plate 6 is 500-1500 Hz, the distortion near the low frequency resonance frequency f0 of the speaker box 100 can be reduced, the second time distortion near the corresponding f0/2 can be reduced, the third time distortion near the f0/3 can be reduced.

When the resonance frequency of the elastic cover plate 6 is 1500-3000 Hz, the medium frequency distortion near 2000 Hz of the speaker box 100 can be reduced, the second time distortion near the corresponding 1000 Hz can be reduced, the third time distortion near 667 Hz can be reduced, etc;

When the resonance frequency of the elastic cover plate 6 is 3000-9000 Hz, the distortion near the high frequency resonance peak Fh of the speaker box 100 can be reduced, the second time distortion near the corresponding Fh/2 can be reduced, the third time distortion near Fh/3 can be reduced, etc;

When the resonance frequency of the elastic cover plate 6 is 9000-15000 Hz, the distortion near the high frequency 12000 Hz of the speaker box 100 can be reduced, the second time distortion near the corresponding 6000 Hz can be reduced, the third time distortion near 4000 Hz can be reduced, etc;

Please refer to FIG. 5, according to the experimental data and effects of the curve in the figure, in this embodiment, the resonance frequency of the elastic cover plate 6 is preferably 3000-9000 Hz, that is, when the resonance frequency the elastic cover plate 6 can absorb is 3000-9000 Hz, under this condition, the distortion spike in total harmonic distortion curve of the speaker box 100 decreases by the most, which means a better effect.

Compared with the related art, the speaker box of the invention provides an elastic cover plate with Young's modulus or strength smaller than that of the housing, in the sound guiding channel of the upper cover, to absorb the resonance frequency energy of a specific frequency, thus weakening the resonance effect of the speaker box, reducing its distortion, and thus improving the acoustic performance of the speaker box.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a housing with an accommodating space and a housing wall;

a propping wall extending from the housing wall toward the accommodating space;

a speaker unit located between the housing wall and the propping wall for dividing the accommodating space into a front cavity and a back cavity, the speaker unit including a diaphragm located in the front cavity for forming a front sound cavity cooperatively with the housing, a sound guiding channel communicating the front sound cavity with outside, and a through hole penetrating the propping wall and communicating the sound guiding channel with the back cavity;

an elastic cover plate covering the through hole completely for absorbing vibration energy at a specific frequency, a Young's modulus or strength of the elastic cover plate being smaller than that of the propping wall.

2. The speaker box as described in claim 1, wherein the elastic cover plate is fixed at a side of the propping wall near the back cavity.

3. The speaker box as described in claim 1, wherein the elastic cover plate is fixed at a side of the sound guiding channel near the back cavity.

4. The speaker box as described in claim 1, wherein the elastic cover plate and the propping wall are fixedly connected by double-shot molding or hot pressing or pasting or ultrasonic welding.

5. The speaker box as described in claim 1, wherein the elastic cover plate and the propping wall are integrated structures.

6. The speaker box as described in claim 1, wherein the specific resonant frequency is 500~15000 Hz.

7. The speaker box as described in claim 6, wherein the specific resonant frequency is 3000~9000 Hz.

8. The speaker box as described in claim 1, wherein the elastic cover plate is made of TPU or MCP or silica gel.

9. The speaker box as described in claim 1 further including a dust screen affixed outside of the sound guiding channel.

10. The speaker box as described in claim 1, wherein the housing comprises a lower cover and an upper cover forming the accommodation space, the upper cover comprises a bottom wall, a first side wall and a second side wall extending along the bottom wall, the propping wall is formed with the first side wall bending and extending toward the second side wall, the speaker unit is held between the propping wall and the second side wall, and the propping wall, the bottom wall and the first side wall cooperatively form the sound guiding channel.

* * * * *